US009552916B2

(12) United States Patent
Kato

(10) Patent No.: US 9,552,916 B2
(45) Date of Patent: Jan. 24, 2017

(54) SOLENOID ACTUATOR

(71) Applicant: DENSO CORPORATION, Kariya (JP)

(72) Inventor: Ichiro Kato, Gamagori (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 14/802,003

(22) Filed: Jul. 17, 2015

(65) Prior Publication Data

US 2016/0071640 A1 Mar. 10, 2016

(30) Foreign Application Priority Data

Sep. 5, 2014 (JP) ..... 2014-181256

(51) Int. Cl.

| | |
|---|---|
| ***H01F 7/122*** | (2006.01) |
| ***H01F 7/16*** | (2006.01) |
| ***F02D 13/02*** | (2006.01) |
| ***H01F 7/02*** | (2006.01) |
| ***H01F 7/08*** | (2006.01) |
| ***F01L 1/047*** | (2006.01) |
| ***F01L 13/00*** | (2006.01) |

(52) U.S. Cl.

CPC ..... *H01F 7/1607* (2013.01); *F01L 1/047* (2013.01); *F01L 13/0036* (2013.01); *F02D 13/0207* (2013.01); *F02D 13/0253* (2013.01); *H01F 7/0278* (2013.01); *H01F 7/0294* (2013.01); *H01F 7/081* (2013.01); *H01F 7/122* (2013.01); *H01F 7/1615* (2013.01); *H01F 7/1646* (2013.01); *F01L 2001/0473* (2013.01); *F01L 2013/0052* (2013.01); *F01L 2820/031* (2013.01)

(58) Field of Classification Search

CPC ..... H01F 7/122; H01F 7/1615; H01F 7/1646; F02D 13/0253

USPC ..... 335/229–234; 123/90.11

See application file for complete search history.

(56) References Cited

U.S. PATENT DOCUMENTS

| | | | | |
|---|---|---|---|---|
| 4,829,947 A * | 5/1989 | Lequesne | ..... | F01L 9/04 123/90.11 |
| 8,448,615 B2 | 5/2013 | Laufenberg et al. | | |
| 2013/0113582 A1 | 5/2013 | Schiepp et al. | | |

FOREIGN PATENT DOCUMENTS

JP 2013-258888 A 12/2013

* cited by examiner

*Primary Examiner* — Ramon M Barrera

(57) ABSTRACT

A plunger is formed of a soft magnetic material to have one end connected a regulation pin. A permanent magnet is affixed to a stationary portion, which is stationary relative to the plunger, to attract the plunger in a retreated direction. A coil generates a magnetic flux in an opposite direction of the permanent magnet to reduce a magneto attraction force, which attracts the plunger. A spring biases the regulation pin in an advanced direction. The spring applies a biasing force to the regulation pin to move the regulation pin in the advanced direction when electricity is supplied to the coil to reduce the magneto attraction force of the permanent magnet. A magnetism detection unit is located on a magnetic circuit, which conducts a magnetic flux generated by the permanent magnet and the coil, to detect a magnetic flux density.

6 Claims, 12 Drawing Sheets

SOLENOID ACTUATOR

CROSS REFERENCE TO RELATED APPLICATION

This application is based on reference Japanese Patent Application No. 2014-181256 filed on Sep. 5, 2014, the disclosure of which is incorporated herein by reference.

TECHNICAL FIELD

The present disclosure may relate to a solenoid actuator configured to advance a regulation pin to fit the regulation pin to a fitting groove thereby to switch a position of a slider. The present disclosure may relate to a solenoid actuator employed in a valve lift control device of an internal combustion engine.

BACKGROUND

Conventionally, a known valve lift control device is configured to control a lift of an intake valve or a lift of an exhaust valve of an internal combustion engine. A valve lift control device may rotate with a camshaft and may switch a position of a slider, which is movable in an axial direction relative to the camshaft. A known solenoid actuator may be employed to switch the position of the slider. For example, the solenoid actuator may alternately activate one of two regulation pins according to the movable direction of the slider. In this way, the solenoid actuator may fit a tip end of the regulation pin to a fitting groove formed in the slider.

SUMMARY

For example, Patent Document 1 may disclose an actuator for switching a valve lift. The actuator may include a stationary core, which is located inside a coil, and a movable unit, which is equipped with a permanent magnet at an end. The movable unit may be movable toward the stationary core and may be movable away from the stationary core. A magnetometric sensor may be equipped radially outside of the permanent magnet to detect change in the magnetic field accompanying movement of the permanent magnet. In this way, the magnetometric sensor may determine an operation state of the movable unit.

(Patent Document 1) U.S. Pat. No. 8,448,615

The actuator of Patent Document 1 may require a mounting space and a wiring space for the magnetometric sensor in the vicinity of the movable unit. Consequently, the configuration of the actuator may be complicated. In addition, the configuration assumes to move the permanent magnet together with the movable unit. Therefore, the configuration may not be applicable to an actuator, in which the permanent magnet is equipped on a stationary side.

The present disclosure may address the above-described concerns.

It is an object of the present disclosure to produce a solenoid actuator is for a valve lift control device. The valve lift control device is configured to control a lift of an intake valve or a lift of an exhaust valve of an internal combustion engine. The valve lift control device has a slider, which is rotatable with a camshaft and is movable in an axial direction relative to the camshaft. The solenoid actuator is configured to advance a regulation pin when fitting a tip end of the regulation pin to a fitting groove of the slider. The solenoid actuator is further configured to cause the regulation pin pushed back by application of a torque of the camshaft when retreating the tip end of the regulation pin from the fitting groove. The solenoid actuator comprises the regulation pin configured to advance to the fitting groove. The solenoid actuator further comprises a plunger formed of a soft magnetic material. The plunger has one end connected with the regulation pin. The solenoid actuator further comprises a permanent magnet affixed to a stationary portion, which is stationary relative to the plunger, and configured to attract the plunger in a retreated direction. The solenoid actuator further comprises a coil configured to generate a magnetic flux in an opposite direction of the permanent magnet to reduce a magneto attraction force, which attracts the plunger. The solenoid actuator further comprises a spring configured to bias the regulation pin in an advanced direction. The spring is configured to apply a biasing force to the regulation pin to move the regulation pin in the advanced direction when electricity is supplied to the coil to reduce the magneto attraction force of the permanent magnet. The solenoid actuator further comprises a magnetism detection unit located on a magnetic circuit, which is configured to conduct a magnetic flux generated by the permanent magnet and the coil, and configured to detect a magnetic flux density.

It is another object of the present disclosure to produce a solenoid actuator comprises a plunger formed of a soft magnetic material. The solenoid actuator further comprises a regulation pin connected to one end of the plunger. The regulation pin has a tip end configured to advance and to retreat. The solenoid actuator further comprises a permanent magnet affixed to a stationary portion, which is stationary relative to the plunger. The permanent magnet is configured to generate a magnetic flux and a magneto attraction force to attract the plunger in a retreated direction. The solenoid actuator further comprises a coil configured to generate a magnetic flux in an opposite direction of the magnetic flux of the permanent magnet to cancel the magnetic flux of the permanent magnet and to reduce the magneto attraction force. The solenoid actuator further comprises a spring configured to apply a biasing force to the regulation pin to move the regulation pin in an advanced direction when electricity is supplied to the coil to reduce the magneto attraction force of the permanent magnet. The solenoid actuator further comprises a magnetism detection unit located on a magnetic circuit, which is configured to conduct the magnetic flux of the permanent magnet and the magnetic flux of the coil, the magnetism detection unit configured to detect a magnetic flux density.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

As follows, a solenoid actuator according to embodiments of the present disclosure will be described with reference to drawings. Publication of unexamined Japanese patent application No. 2013-258888 discloses a valve lift control device. The valve lift control device includes a cam integrated with a slider, which rotates together with a camshaft. The cam is to control a lift of an intake valve or a lift of an exhaust valve for an internal combustion engine. The solenoid actuator is equipped to, for example, the valve lift control device.

A slider of a valve lift control device is rotatable together with a camshaft and is movable in the axial direction relative to the camshaft. The slider has an outer circumferential periphery defining a fitting groove, which gradually changes in the axial position according to the rotation angle. The solenoid actuator advances one of two operation-side regulation pins according to an instruction from a control unit. In this way, the solenoid actuator fits a tip end of the operation-side regulation pin on the fitting groove of the slider, thereby to move the slider in the axial direction with rotation. When the solenoid actuator moves the tip end of the operation-side regulation pin away from the fitting groove, the operation-side regulation pin is pushed back by application of a torque of the camshaft. Publication of unexamined Japanese patent application No. 2013-258888 describes the configuration and the operation of the valve lift control device in detail. Therefore, detailed description for the configuration and the operation is omitted.

(First Embodiment)

Figure 1:
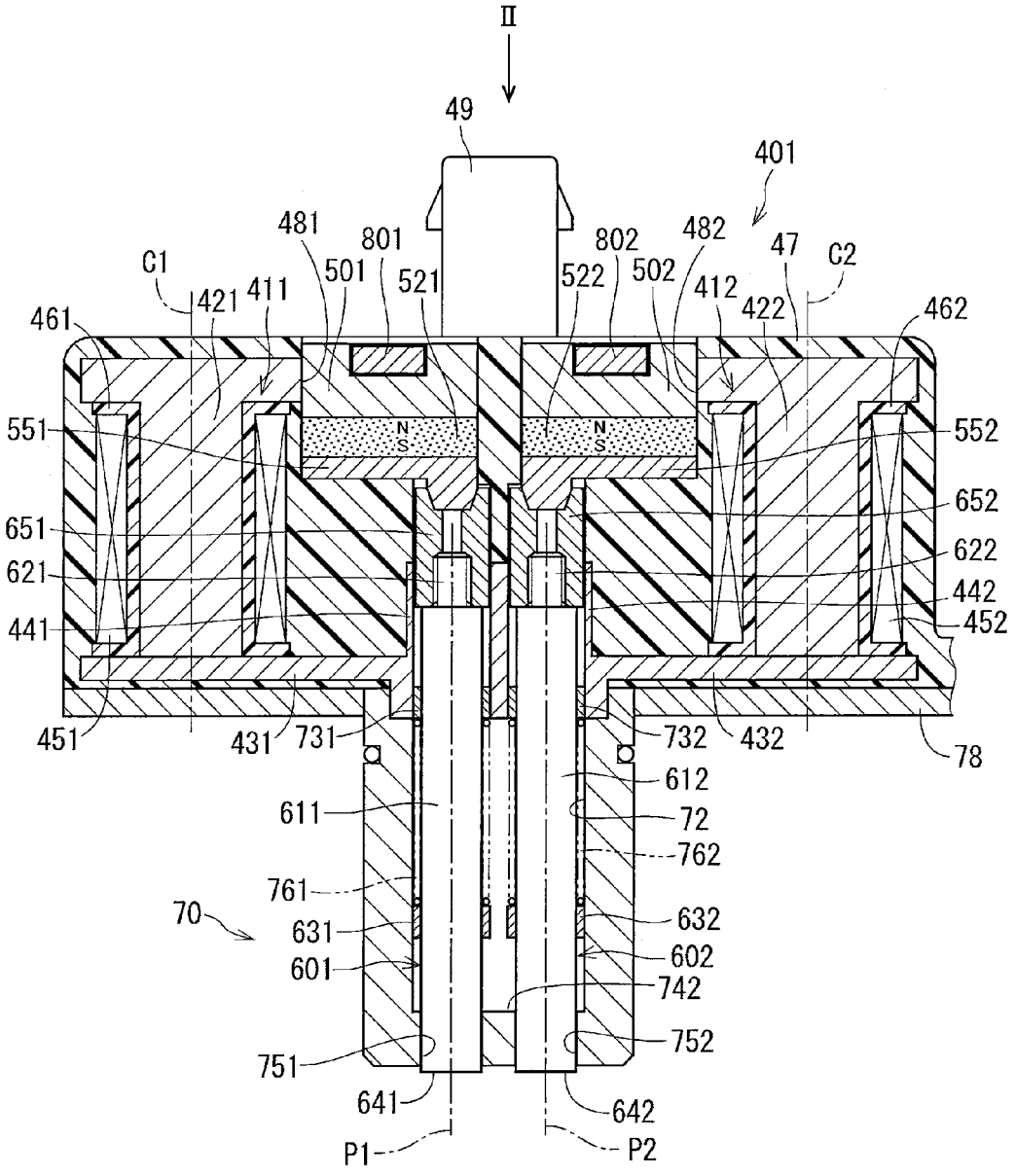
FIG. 1 is a sectional view showing a solenoid actuator in a de-energized state according to a first embodiment of the present disclosure.
Figure 2:
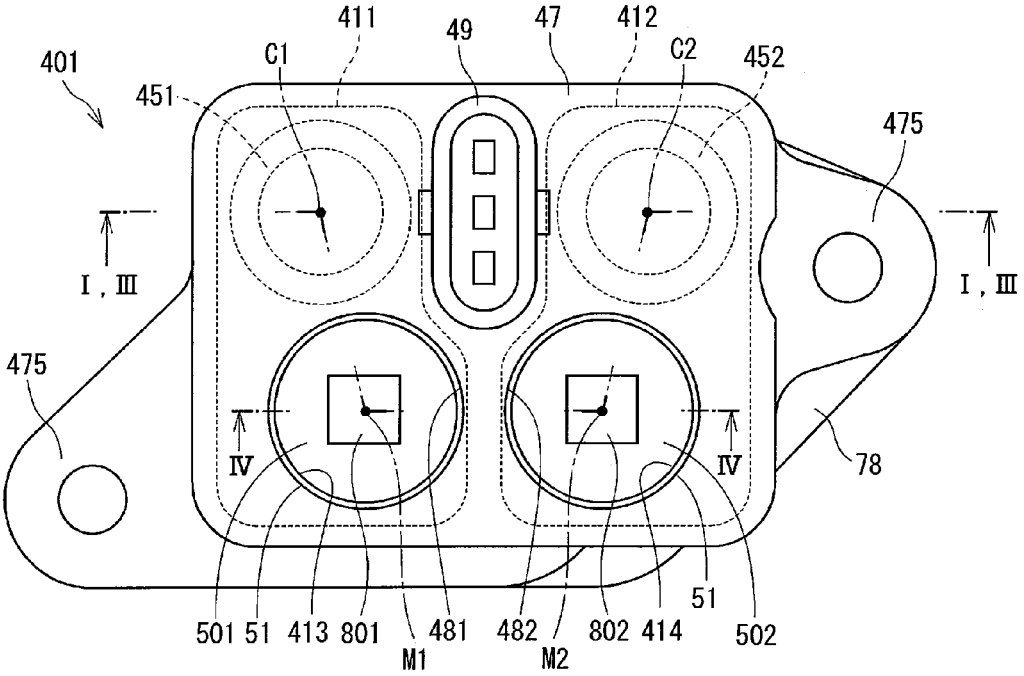
FIG. 2 is a plan view when being viewed along an arrow II in FIG. 1.
Figure 3:
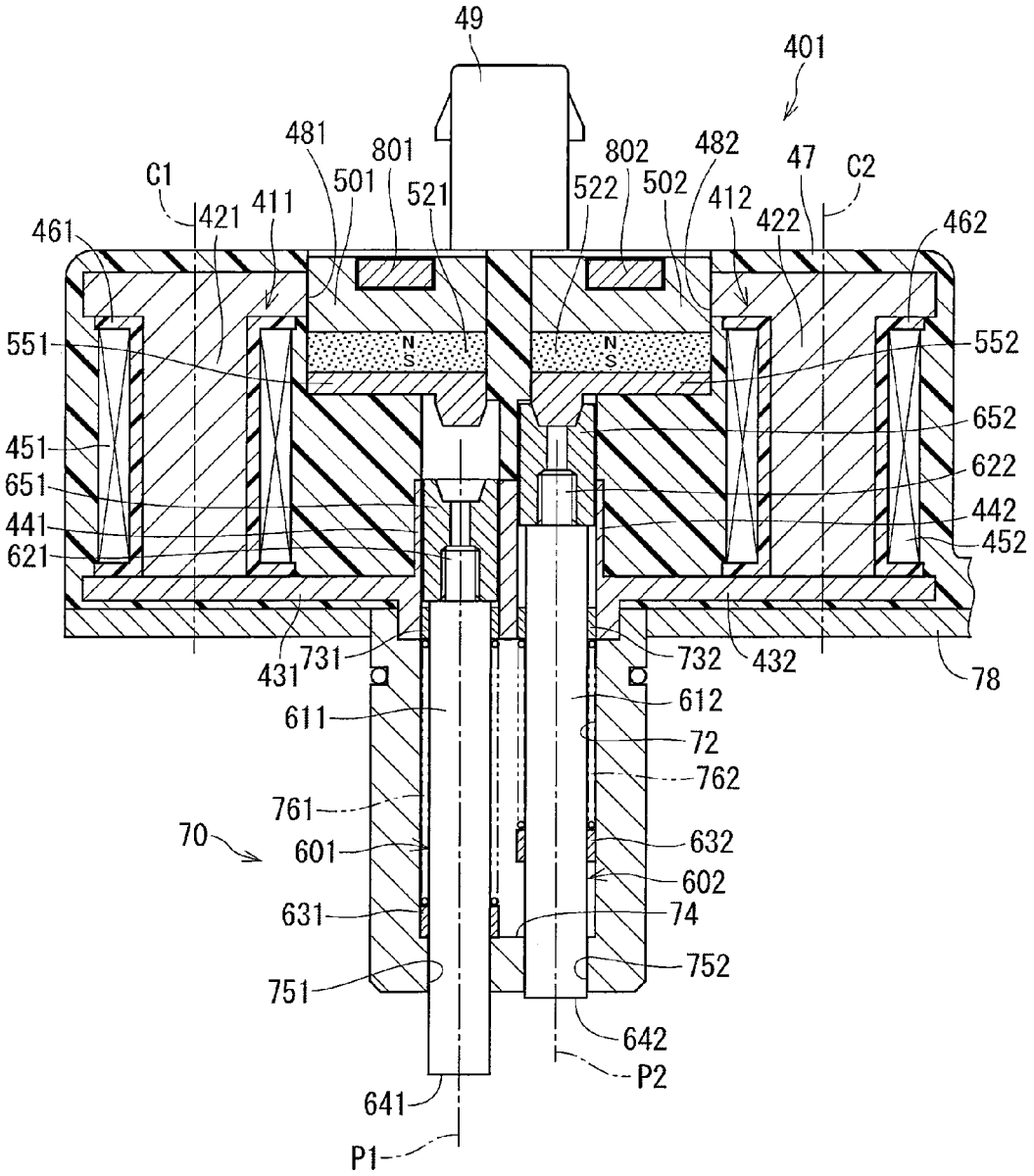
FIG. 3 is a sectional view showing the solenoid actuator in a first coil electricity supply state.
Figure 4:
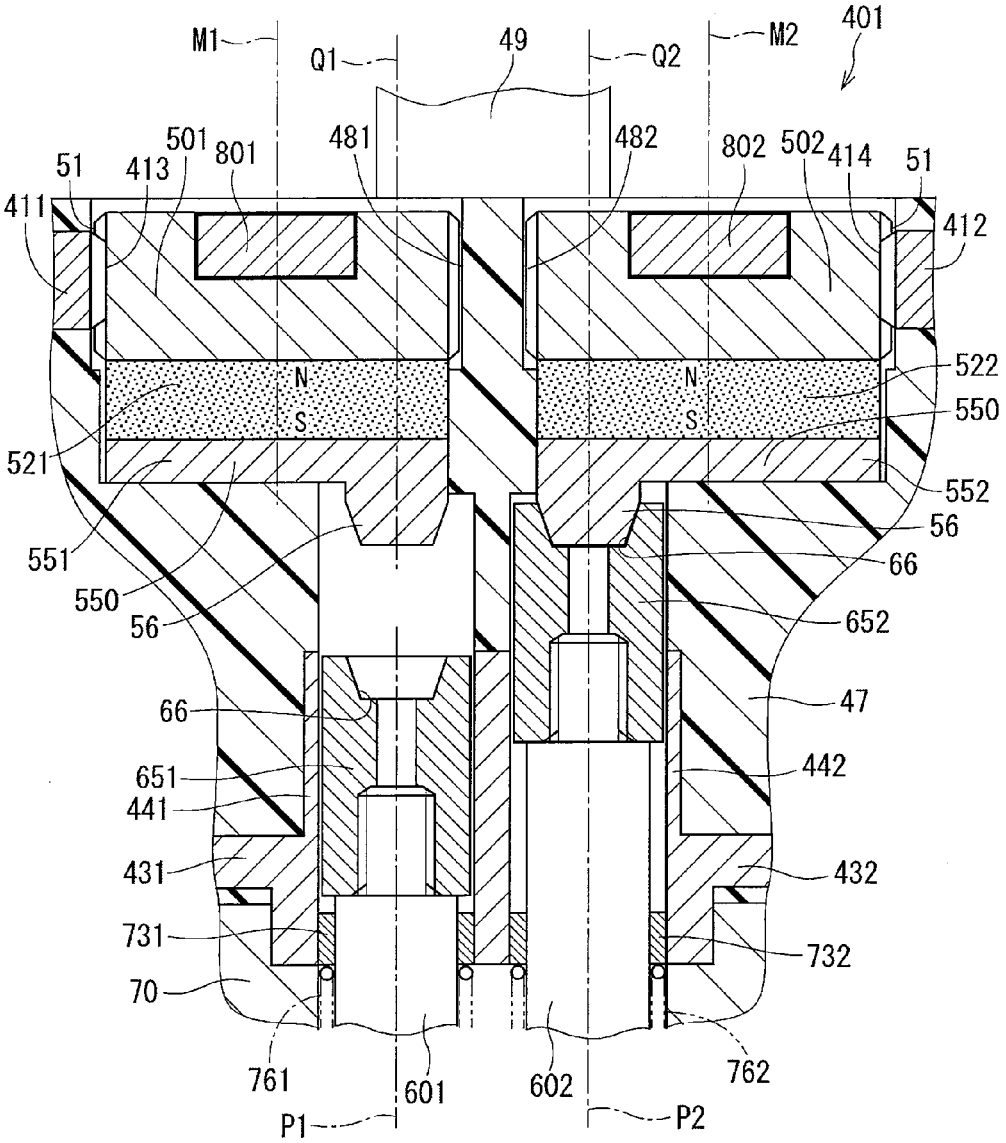
FIG. 4 is an enlarged view showing a portion of the solenoid actuator in FIG. 3.

A configuration of a solenoid actuator according to a first embodiment of the present disclosure will be described with reference to FIGS. 1 to 4. A solenoid actuator 401 includes two regulation pins 601 and 602 arranged in parallel with each other. The solenoid actuator 401 selectively activates one of the two regulation pins 601 and 602 as an operation-side regulation pin. FIG. 1 is a sectional view showing a state where none of the regulation pins 601 and 602 is activated. FIGS. 3 and 4 are sectional views each showing a state where the first regulation pin 601 is activated. Sectional views created by flipping FIGS. 3 and 4 in the horizontal direction may represent a state where the second regulation pin 602 is activated. Therefore, drawing of the state is omitted. As shown in FIG. 2, a solenoid actuator 40 is symmetric relative to the horizontal direction in the drawing, excluding mount portions 475, which are projected outward form a main body of the solenoid actuator 40.

The solenoid actuator 401 includes a pair of components correspondingly to the two regulation pins 601 and 602. Specifically, the solenoid actuator 401 includes coils 451 and 452, lids 501 and 502, permanent magnets 521 and 522, adapters 551 and 552, plungers 651 and 652, springs 761 and 762, and/or the like. It is noted that, the components, each of which is labeled with 1 at the last digit of the three-digit reference numeral, correspond to each other, and the components, each of which is labeled with 2 at the last digit of the three-digit reference numeral, correspond to each other. As follows, a component, which is labeled with 1 at the last digit of the three-digit reference numeral, is prefixed with first, and a component, which is labeled with 2 at the last digit of the three-digit reference numeral, is prefixed with second. In this way, the first component and the second component are distinguished from each other.

The regulation pins 601 and 602 and the plungers 651 and 652 may function as movable portions. The first regulation pin 601 and a first plunger 651 are integrally joined to each other and are located on a pin axis P1. The first regulation pin 601 and the first plunger 651 are movable back and forth from a most retreated position shown in FIG. 1 to a most advanced position shown in FIG. 3. The second regulation pin 602 and the second plunger 652 are integrally joined to each other and are located on a pin axis P2. The second regulation pin 602 and the second plunger 652 are movable similarly to the first regulation pin 601 and the first plunger 651.

An advanced distance of the regulation pins 601 and 602 and the plungers 651 and 652 from the most retreated position represents a stroke. The most retreated position of the regulation pins 601 and 602 and the plungers 651 and 652 represents a zero stroke. The most advanced position of the regulation pins 601 and 602 and the plungers 651 and 652 represents a full stroke. In the following description, an advanced direction or front may correspond to the lower direction in FIGS. 1, 3, and 4, and a retreated direction or rear may correspond to the upper direction in FIGS. 1, 3, and 4. The direction, in which the regulation pins 601 and 602 is advanced and retreated, represents an axial direction of the solenoid actuator 401. A direction, which is perpendicular to the axial direction of the solenoid actuator 401, represents a radial direction.

The coils 451 and 452, the lids 501 and 502, the permanent magnets 521 and 522, and the adapters 551 and 552 form a stationary portion. In addition to those components, rear yokes 411 and 412, coil cores 421 and 422, front yokes 431 and 432, a sleeve 70, an attachment plate 78, and the like further form the stationary portion. The stationary portion is a static component contrary to a movable portion such as the plungers 651 and 652 and/or the like. As follows, the configuration of the stationary portion will be described in order. Subsequently, the configuration of the movable portion will be described.

The rear yokes 411 and 412, the coil cores 421 and 422, the front yoke 431 and 432, and the like are soft magnetic members forming magnetic circuits. The stationary portion has an outer shell located rear, and the outer shell is molded of resin with a resin molded portion 47. More specifically, the rear yokes 411 and 412, the coil cores 421 and 422, the front yoke 431 and 432, the coils 451 and 452, the bobbin 461, and 462, and the like are molded of resin with the resin molded portion 47. These molded components are integrally formed on the rear side of the attachment plate 78. The resin molded portion 47 has two magnet accommodation holes 481 and 482 opened rearward. The resin molded portion 47 is equipped with a connector 49 projected rearward.

The rear yokes 411 and 412 and the front yokes 431 and 432 are each in a plate form and are in parallel with each other. The rear yokes 411 and 412 and the front yokes 431 and 432 perpendicularly intersect with the pin axes P1 and P2. The coil cores 421 and 422 are each in a tubular form and have coil axes C1 and C2, respectively. The coil cores 421 and 422 connect the rear yokes 411 and 412 with the front yokes 431 and 432, respectively. The pin axes P1 and P2 are connected to the front yokes 431 and 432, respectively. Plunger guide portions 441 and 442 are each in a tubular shape and are formed around the pin axes P1 and P2, respectively. The plunger guide portions 441 and 442 are connected to each other at a position between the pin axes P1 and P2.

The bobbins 461 and 462 are attached to the outer peripheries of the coil cores 421 and 422, respectively. The coils 451 and 452 are formed by winding wires to form windings around the outer circumferential peripheries of the bobbins 461 and 462, respectively. The bobbins 461 and 462 are formed of resin to insulate the coil cores 421 and 422 from the windings of the coils 451 and 452, respectively. Electricity is supplied from an external electric power source through the connector 49 to one of the coils 451 and 452 corresponding to the operation-side regulation pin thereby to cause the one of the coils 451 and 452 to generate a magnetic field. The magnetic field causes a magnetic flux to pass along a path in a direction. The path and the direction of the magnetic flux will be described later.

The magnet accommodation holes 481 and 482 of the resin molded portion 47 are each formed in a tubular shape centered on magnetic axes M1 and M2, respectively. The magnet accommodation holes 481 and 482 accommodate the adapters 551 and 552, the permanent magnets 521 and 522, and the lids 501 and 502, respectively, in this order from the bottom side.

As shown in FIGS. 2 and 4, the magnet accommodation holes 481 and 482 have inner walls from which female screw portions 413 and 414 are exposed, respectively. The female screw portions 413 and 414 are formed on the rear yokes 411 and 412, respectively. The lids 501 and 502 have sidewalls defining male screw portions 51, respectively. The male screw portions 51 are screwed into the female screw portions 413 and 414, respectively. In this way, the male screw portions 51 are held by the rear yokes 411 and 412, respectively, to surround the permanent magnets 521 and 522, respectively.

The lids 501 and 502 form the stationary portion and have upper end surfaces to which magnetometric sensors 801 and 802 are equipped, respectively. The magnetometric sensors 801 and 802 may function as magnetism detection units to detect magnetic flux density. The magnetometric sensors 801 and 802 according to the present embodiment are hall elements. It is noted that, the magnetometric sensors 801 and 802 according to another embodiment may be magnetoresistive (MR) elements or the like. The magnetometric sensors 801 and 802 may be embedded in recessed portions formed in the lids 501 and 502, respectively. Alternatively, the magnetometric sensors 801 and 802 may be laid on surfaces of the lids 501 and 502, respectively. According to the present configuration, the magnetometric sensors 801 and 802 according to the present embodiment are equipped to end surfaces on the opposite side of the permanent magnets 521 and 522 from the plungers 651 and 652, respectively. The arrangement facilitates installation of the magnetometric sensors 801 and 802 from the upper side of the lids 501 and 502, without requiring exclusive spaces. Electric wires for the magnetometric sensors 801 and 802, such as wires coupled with the electric power source, wires coupled with the ground, signal lines, and/or the like, are laid through an unillustrated path and drawn into the connector 49. The electric wires for the magnetometric sensors 801 and 802 are coupled with an external control device.

Figure 5:
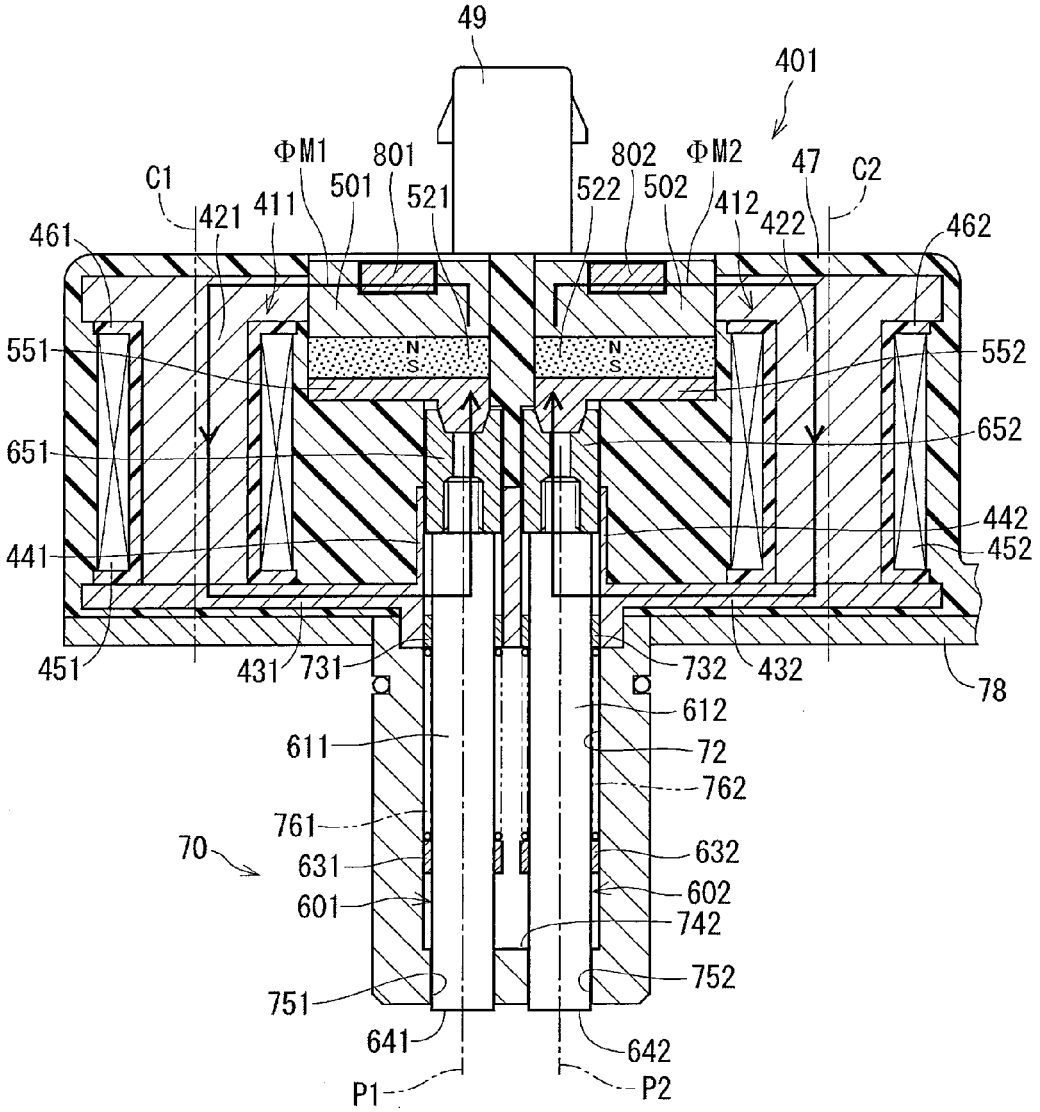
FIG. 5 is a sectional view showing the solenoid actuator and showing a magnetic flux, which flows through a magnetic circuit in a de-energized state in which a first plunger is retreated.
Figure 6:
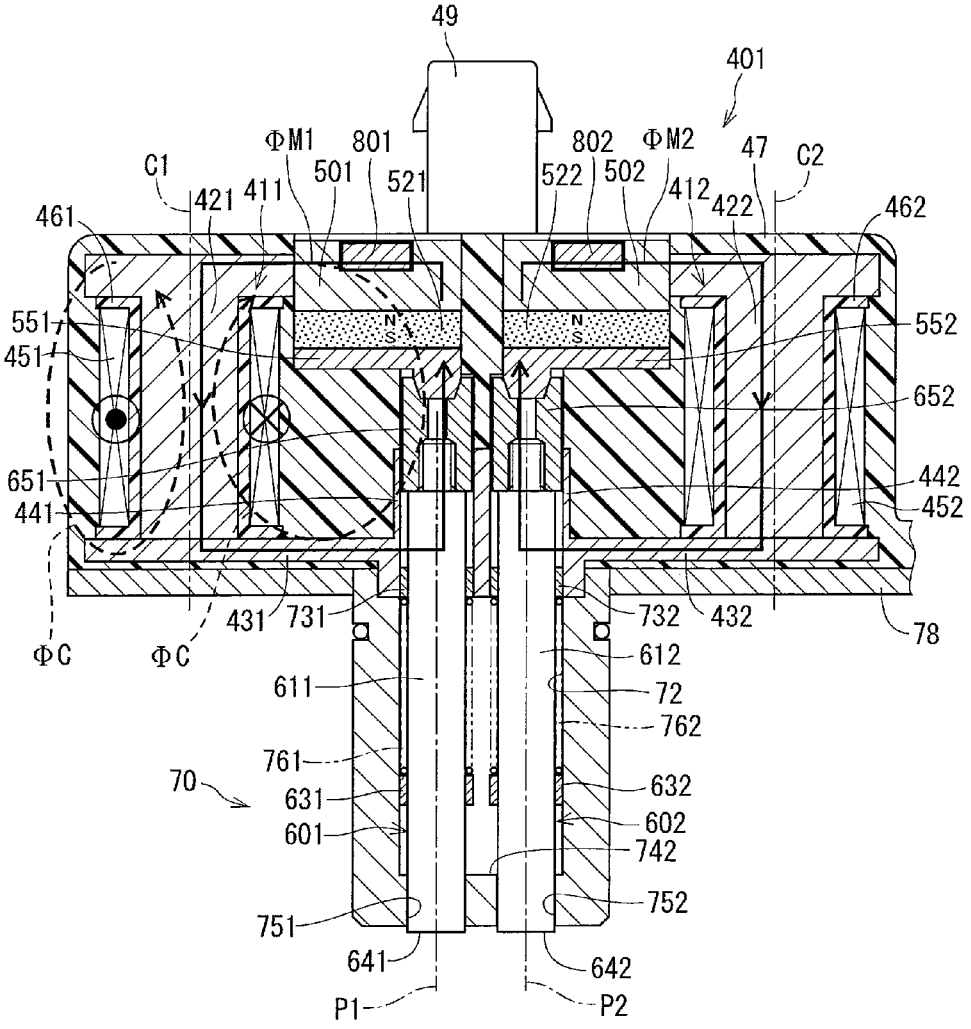
FIG. 6 is a sectional view showing a magnetic flux, which flows through a magnetic circuit in a state of first plunger advance start when electricity supply to the first coil is started in the state of FIG. 5.
Figure 7:
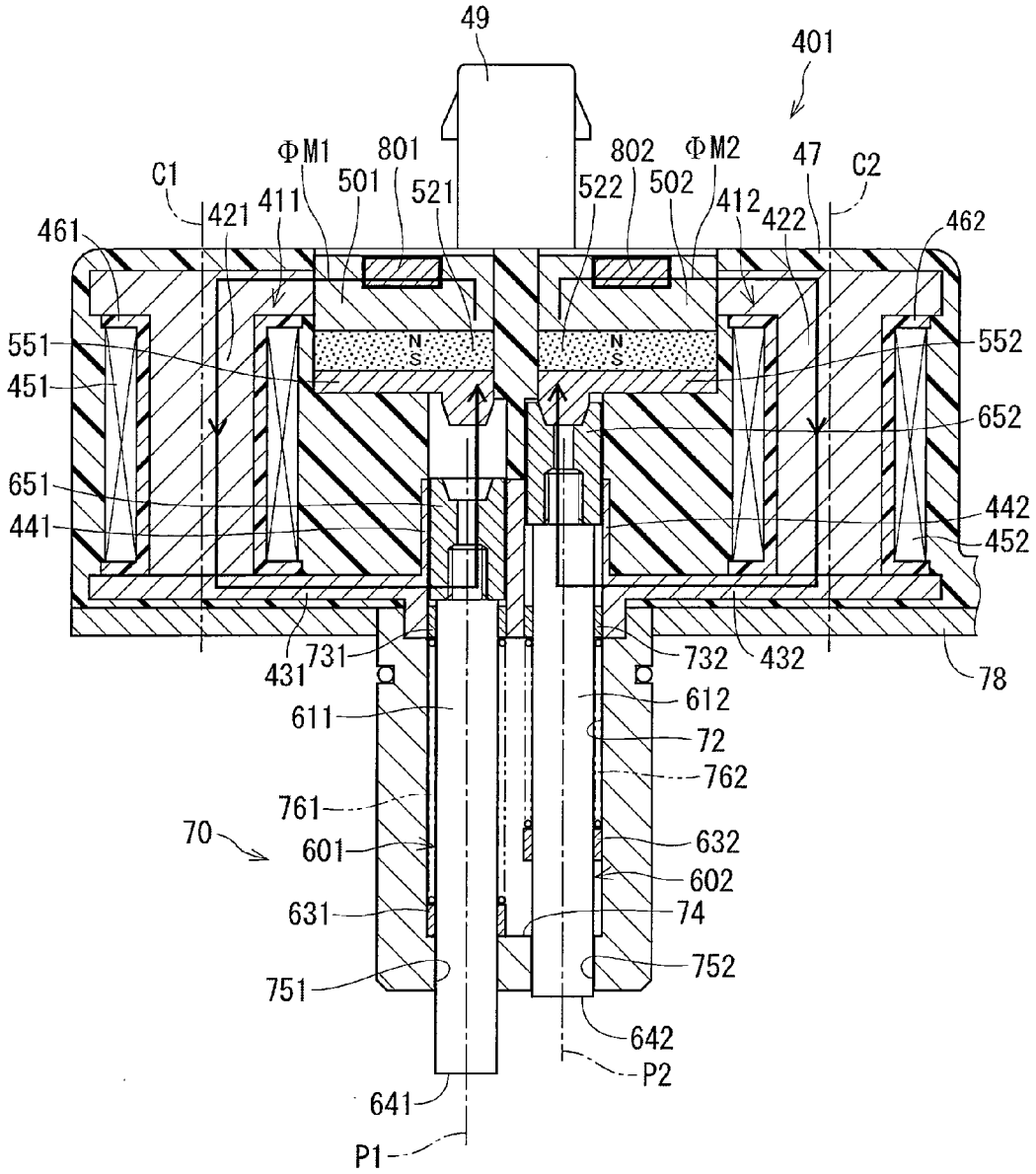
FIG. 7 is a sectional view showing a magnetic flux, which flows through a magnetic circuit in a state of first plunger advance end when electricity supply to the first coil is terminated in the state of FIG. 6.

As shown in FIGS. 5 to 7, the permanent magnets 521 and 522 and the coils 451 and 452 form magnetic circuits through which magnetic fluxes generated by the coils 451 and 452 pass, respectively. As described later, the magnetometric sensors 801 and 802 are laid on the magnetic circuits to detect the density of the magnetic fluxes passing through the magnetic circuits, respectively. That is, the magnetometric sensors 801 and 802 detect intensity of the magnetic fluxes. The solenoid actuator 401 determines operation states such as quantities of advance and retreat of the regulation pins 601 and 602 according to output signals from the magnetometric sensors 801 and 802. Thus, the solenoid actuator 401 determines whether the regulation pins 601 and 602 are each advanced or retreated.

Each of the permanent magnets 521 and 522 is in a plate shape having a circular shape in cross section taken along the radial direction. Each of the permanent magnets 521 and 522 has a diameter, which is greater than the diameter of corresponding one of the plungers 651 and 652. According to the first embodiment, the first permanent magnet 521 and the second permanent magnet 522 are magnetized such that those magnetic poles are directed in the same direction. In the illustrated example, each of the first permanent magnet 521 and the second permanent magnet 522 has the N pole on the side of the lids 501 and 502 and has the S pole on the side of the plungers 651 and 652. It is noted that, each of the first permanent magnet 521 and the second permanent magnet 522 may have the S pole on the side of the lids 501 and 502 and may have the N pole on the side of the plungers 651 and 652.

Each of the adapters 551 and 552 is formed of a soft magnetic material such as a ferrous material. The adapters 551 and 552 are equipped to ends of the permanent magnets 521 and 522 on the side of the plungers 651 and 652, respectively. The adapters 551 and 552 are magnetized with the permanent magnets 521 and 522, respectively. The adapters 551 and 552 may function as magneto convergent members to converge magnetic fluxes of the permanent magnets 521 and 522 and to transmit the converged magnetic fluxes to the plungers 651 and 652, respectively.

Each of the adapters 551 and 552 has a body 550 and a fitting portion 56. The body 550 is in a plate shape and has a cross-sectional area in the radial direction, the cross-sectional area being equivalent to the cross-sectional area of corresponding one of the permanent magnets 521 and 522. The fitting portion 56 is in a projected tapered-shape and is projected from the body 550 toward corresponding one of the plungers 651 and 652. It is noted that the tapered shape includes a truncated cone shape. Axes Q1 and Q2 of the fitting portions 56 are offset from magnetic axes M1 and M2, respectively. The axes Q1 and Q2 coincide with pin axes P1 and P2, respectively, within a center of variation.

The sleeve 70 forms an outer shell of a front portion of the stationary portion. The sleeve 70 is in a tubular shape and is located on the front side of a center portion of the attachment plate 78. The sleeve 70 has an accommodation hole 72. Each of the regulation pins 601 and 602 and each of the springs 761 and 762 is accommodated in the accommodation hole 72. The accommodation hole 72 has a hole end 74. Each of sliding holes 751 and 752 is formed in the corresponding hole end 74. The regulation pins 601 and 602 are slidable along the sliding holes 751 and 752, respectively. Bushes 731 and 732 are affixed inside the plunger guide portions 441 and 442, respectively.

The regulation pins 601 and 602 and the plungers 651 and 652 may function as movable portions. Subsequently, the first regulation pin 601 and the first plunger 651 will be described as one representative example. The regulation pin 601 includes an axis main body 611, a connecting portion 621 connected with the plunger 651, and a collar portion 631, which are coaxial with the pin axis P1. The collar portion 631 forms a seat surface of the spring 761. The collar portion 631 may be formed by press-fitting a collar, which is a separate component from the axis main body 611, to the axis main body 611. Alternatively, the collar portion 631 may be formed integrally with the axis main body 611.

Most of the axis main body 611 excluding a tip end 641 is accommodated in the sleeve 70. The axis main body 611 is guided along a hole of the bush 731 on the rear side of the sleeve 70. The axis main body 611 is guided along the sliding hole 751 on the front of the sleeve 70. Thus, the axis main body 611 is slidable relative to the bush 731 and the sliding hole 751. The tip end 641 is projected from the sleeve 70. The tip end 641 is fitted to a fitting groove of a slide of the valve lift control device when being advanced.

The plunger 651 is in a tubular shape and is formed of a soft magnetic material such as a ferrous material. The plunger 651 is connected with the connecting portion 621 of the regulation pin 601. The plunger 651 is guided by the plunger guide portion 441. The plunger 651 is advanced and retreated integrally with the regulation pin 601. The adapter 551 has an end surface on the side of the plunger 651, and the end surface is equipped with a receiver portion 66. The receiver portion 66 is in a tapered recessed shape and receives the fitting portion 56. The plunger 651 is biased by a magneto attraction force of the permanent magnet 521 toward the adapter 551 in the retreated direction. When the plunger 651 is attracted by the adapter 551, the fitting portion 56 of the adapter 551 is fitted to the receiver portion 66 of the plunger 651. The second regulation pin 602 and the second plunger 652 may have the above-described configuration.

The springs 761 and 762 are fitted to the outer peripheries of the axis main bodies 611 and 612 of the regulation pins 601 and 602, respectively. The springs 761 and 762 are supported at both ends between the bushes 731 and 732 and the collar portions 631 and 632, respectively. The springs 761 and 762 bias the collar portions 631 and 632 to move the collar portions 631 and 632 away from the bushes 731 and 732, respectively. In this way, the springs 761 and 762 bias the regulation pins 601 and 602 in the advanced direction, respectively.

As described above, the first plunger 651 and the first regulation pin 601 are connected integrally with each other, and the second plunger 652 and the second regulation pin 602 are connected integrally with each other. Both the first plunger 651 and the first regulation pin 601 and both the second plunger 652 and the second regulation pin 602 receive the magneto attraction forces from the permanent magnets 521 and 522 and receive the spring forces from the springs 761 and 762, respectively, in the opposite directions. As the magneto attraction force changes, the plungers 651 and 652 move in a direction along one of the magneto attraction force and the spring force greater than the other.

Subsequently, operation of the solenoid actuator 401 with the above-described configuration will be described with reference to FIGS. 5 to 7. FIG. 5 shows magnetic fluxes passing through the magnetic circuits in a de-energized state. FIG. 6 shows magnetic fluxes passing through the magnetic circuits when electricity supply to the first coil 451 is started to energize the magnetic circuits. FIG. 7 shows magnetic fluxes passing through the magnetic circuits when electricity supply to the first coil 451 is terminated to de-energize the magnetic circuits after the first regulation pin 601 completes to advance. As shown in FIGS. 5 to 7, the magnetometric sensors 801 and 802 are equipped on the magnetic circuits, respectively.

(De-Energized State)

As shown in FIG. 5, in the de-energized state, a magnetic flux ΦM1 generated by the first permanent magnet 521 and a magnetic flux ΦM2 generated by the second permanent magnet 522 form independent closed circuits, respectively. The first permanent magnet 521 generates the magnetic flux ΦM1 at the N pole of the first permanent magnet 521 to pass through the first lid 501, the first rear yoke 411, the first coil core 421, the first front yoke 431, the first plunger guide portion 441, the first plunger 651, and the first adapter 551. The magnetic flux ΦM1 reaches the S pole of the first permanent magnet 521. The magnetic flux ΦM2 generated by the second permanent magnet 522 passes through a path symmetric to the above-described path. In the present state, the magnetometric sensor 801 equipped on the magnetic path of the magnetic flux ΦM1 and the magnetometric sensor 802 equipped on the magnetic path of the magnetic flux ΦM2 detect the magnetic flux density in the magnetism paths, respectively.

(First Coil Electricity Supply Start)

FIG. 6 shows electric current supplied to the first coil 451. The electric current goes from the behind of the drawing to the front side of the drawing on the left side relative to the coil axis C1. The electric current further goes from the front side of the drawing to the behind of the drawing on the right side relative to the coil axis C1. Thus, the electric current causes the first coil core 421 to generate a coil magnetic flux ΦC (long dashed line) to go upward from the lower side in the drawing. The coil magnetic flux ΦC is generated in a direction to cancel the magnetic flux ΦM1 generated by the first permanent magnet 521. Therefore, the magneto attraction force working on the first plunger 651 decreases. In this way, a retention force to retain the first plunger 651 at the most retreated position is eliminated. Therefore, the first regulation pin 601 starts to advance with application of the biasing force from the first spring 761.

(First Coil Electricity Supply End)

As shown in FIG. 7, when the first regulation pin 601 reaches the most advanced position, electricity supply to the first coil 451 is terminated. It is noted that, in dependence upon the balance between the spring force and the magneto attraction force, electricity supply may be terminated in the course of the stroke after the regulation pin 601 begins to advance. In the present state, electricity supply to the first coil 451 is terminated, thereby to eliminate the coil magnetic flux ΦC. Thus, only the magneto magnetic flux ΦM1 and ΦM2 remain similarly to the de-energized state (refer to FIG. 5). However, the position of the first plunger 651 in the magnetic flux path of the magnetic flux ΦM1 differs from the position in the de-energized state. Thereby the magnetic flux density detected with the magnetometric sensor 801 differs from the magnetic flux density in the de-energized state.

When electricity is supplied to the first coil (first coil electricity supply state), the first regulation pin 601 functions as the operation-side regulation pin, and the tip end 641 of the first regulation pin 601 is fitted to the fitting groove of the slider. Contrary to the above description, when the second regulation pin 602 is advanced as the operation-side regulation pin, electricity is supplied to the second coil 452 such that the second coil core 422 generates the coil magnetic flux ΦC in the direction to cancel the magnetic flux ΦM2 generated by the second permanent magnet 522. In this way, the second coil core 422 generates the coil magnetic flux ΦC in the direction from the upper side to the lower side in the drawing.

With the present configuration of the solenoid actuator 401, both the regulation pins 601 and 602 are not activated in the de-energized state. In addition, only the first regulation pin 601 is activated in the first coil electricity supply state, and only the second regulation pin 602 is activated in a second coil electricity supply state. In the present structure, the solenoid actuator 401 is configured to switch electricity supply to the coils 451 and 452 thereby to selectively activate one of the two regulation pins 601 and 602.

Figures 8A, 8B, 8C:
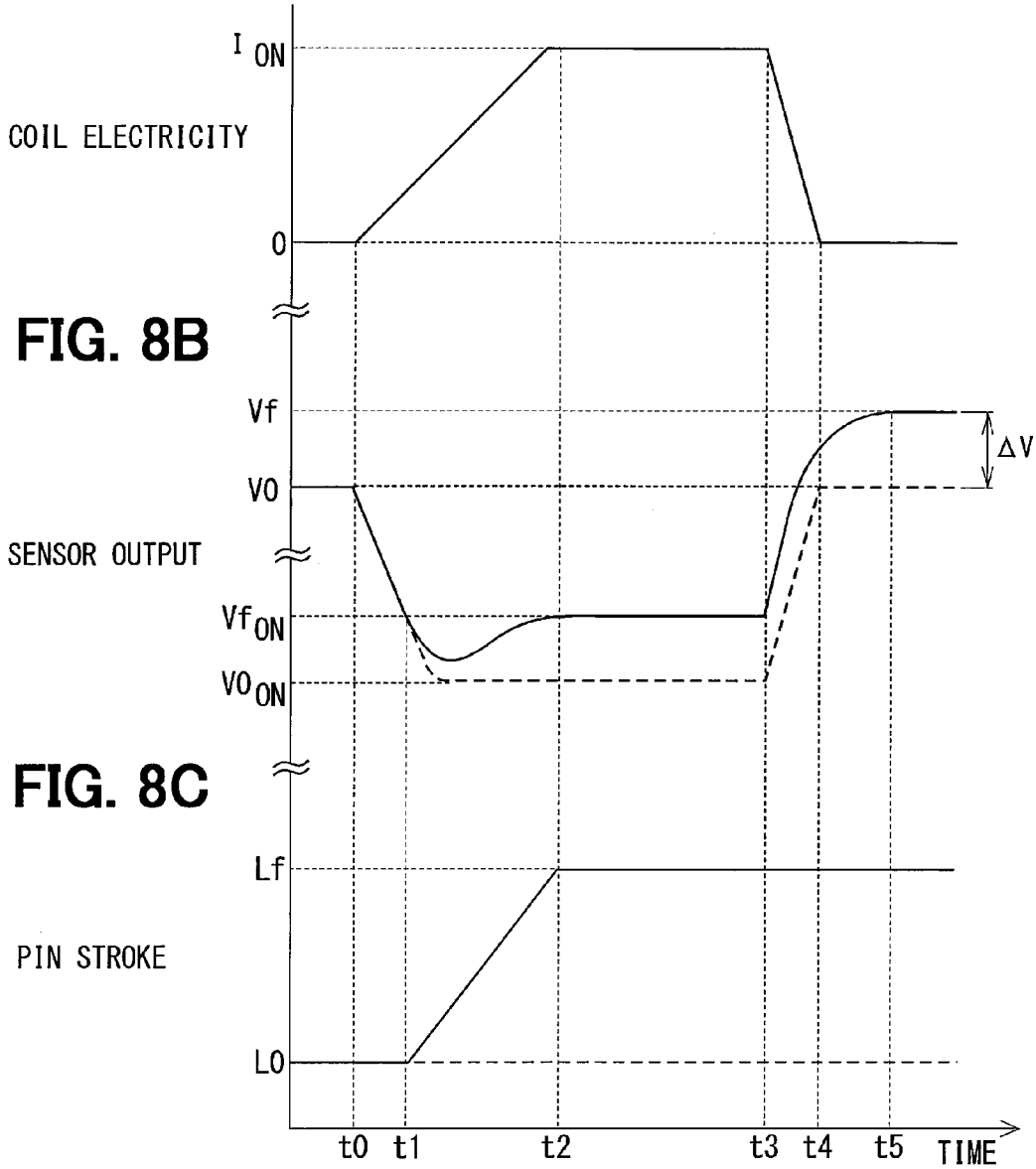
FIG. 8A is a time chart showing a coil current.
FIG. 8B is a time chart showing a magnetometric sensor output.
FIG. 8C is a time chart showing a regulation pin stroke, in a coil electricity supply state.

Subsequently, experimental data will be described with reference to the time chart of FIGS. 8A to 8C. In the drawings, FIG. 8A represents a coil current, FIG. 8B represents a magnetometric sensor output, and FIG. 8C represents a regulation pin stroke change, in the state of the coil electricity supply. In the present example, the magnetometric sensor output is a voltage signal. In FIGS. 8B and 8C, the solid line represents data when the first regulation pin 601 is activated normally, and the dashed line represents data in the non-activated state when the first magneto magnetic flux ΦM1 is fixed forcedly at the most retreated position.

The state before the time t0 in FIGS. 8A to 8C corresponds to the de-energized state in FIG. 5. The magnetometric sensor output is an initial output V0 corresponding to the magnetic flux density of the magneto magnetic flux ΦM1 when the regulation pin 601 is at the most retreated position. The time period between t0 and t1 corresponds to the coil electricity supply start in FIG. 6. Specifically, electricity supply to the coil 451 is started at the time t0, and the coil current increases from 0 to ION. The sum of the magnetic force generated by the coil 451 and the spring force exceeds the magneto attraction force of the permanent magnet 521 at the time t1. At the time t1, the regulation pin 601 begins to advance. In addition, as the coil current increases, the coil magnetic flux ΦC increases in a direction to cancel the magneto magnetic flux ΦM1. Therefore, the magnetometric sensor output decreases.

The time period t1 to t4 corresponds to the state between FIGS. 6 and 7. The regulation pin 601 moves from a zero stroke L0 to a full stroke Lf in the time period t1 to t2. The regulation pin 601 is retained at the full stroke Lf after the time t2. In a normal operation state, the magnetometric sensor output shown by the solid line undershoots after the time t1 and converges with an output VfON by the time t2. To the contrary, the regulation pin 601 is forcedly retained at the zero stroke L0 in a non-activated state. In the non-activated state, the magnetometric sensor output shown by the dashed line converges with an output V0ON after the time t1. When electricity supply is terminated at the time t3, the coil magnetic flux ΦC disappears, and the magnetometric sensor output increases.

Subsequently, the coil current becomes zero at the time t4. The time t5 corresponds to the coil electricity supply end in FIG. 7. As the time t5, the magnetometric sensor output in the normal operation state becomes the after-operation output Vf. The after-operation output Vf corresponds to the magnetic flux density generated by the magneto magnetic flux ΦM1 when the regulation pin 601 is at the most advanced position. To the contrary, the magnetometric sensor output shown by the dashed line in the non-activated state returns to the initial output V0. As described above, the initial output V0, which corresponds to the most retreated position of the regulation pin 601, and the after-operation output Vf, which corresponds to the most retreated position of the regulation pin 601, have an output difference ΔV therebetween.

In this way, in the first coil electricity supply state, the operation state of the regulation pin 601 can be determined according to the output difference ΔV between the after-operation output Vf, which is detected with the magnetometric sensor 801, and the initial output V0. Similarly, in the second coil electricity supply state, the operation state of the regulation pin 602 can be determined according to the output difference ΔV between the after-operation output Vf, which is detected with the magnetometric sensor 802, and the initial output V0. In addition, it is possible to determine which one of the regulation pins 601 and 602 is activated according to the result.

(Effect)

As follows, effects of the solenoid actuator 401 of the present embodiment will be described.

(1) In the present embodiment, the magnetometric sensors 801 and 802, which are to detect the magnetic flux densities, are located on the magnetic circuits, respectively. The magnetic circuits conduct the magnetic fluxes ΦM1, ΦM2, and ΦC, which are generated by the permanent magnets 521 and 522 and the coils 451 and 452. In addition, the solenoid actuator 401 detects the change in the magnetic flux density between that in the state where the plungers 651 and 652 are advanced relative to the permanent magnets 521 and 522 and that in the state where the plungers 651 and 652 are retarded relative to the permanent magnets 521 and 522. The present configuration may enable the solenoid actuator, which includes the permanent magnets fixed to the stationary portion, to determine the operation state of the regulation pins 601 and 602 suitably.

(2) The solenoid actuator 401 of the present embodiment is equipped with the two regulation pins 601 and 602 located in parallel. In addition, the solenoid actuator 401 further includes the two plungers 651 and 652, the two permanent magnets 521 and 522, the two springs 761 and 762 the two magnetometric sensors 801 and 802, and the like, correspondingly to the two regulation pins 601 and 602. Electricity is supplied to one of the coils 451 and 452 to generate the magnetic flux in the opposite direction of the permanent magnet, which corresponds to one of the regulation pins, thereby to reduce the magneto attraction force. Thus, the regulation pin is advanced as the operation-side regulation pin. The solenoid actuator has the above-described two-pin configuration and enables to determine whether which one of the regulation pins is advanced according to the output of the magnetometric sensors 801 and 802.

(3) In the present embodiment, the magnetometric sensors 801 and 802 are located on the end surfaces of the lids 501 and 502, respectively. The lids 501 and 502 are located on the opposite side of the permanent magnets 521 and 522 from the plungers 651 and 652, respectively. The arrangement does not require an exclusive space for the magnetometric sensor 801 and 802. In addition, the arrangement facilitates installation and wiring of the magnetometric sensors 801 and 802. Therefore, the present configuration may enable to downsize and simplify the configuration compared with the conventional configuration of the Patent Document 1.

(Second Embodiment)

Figure 9:
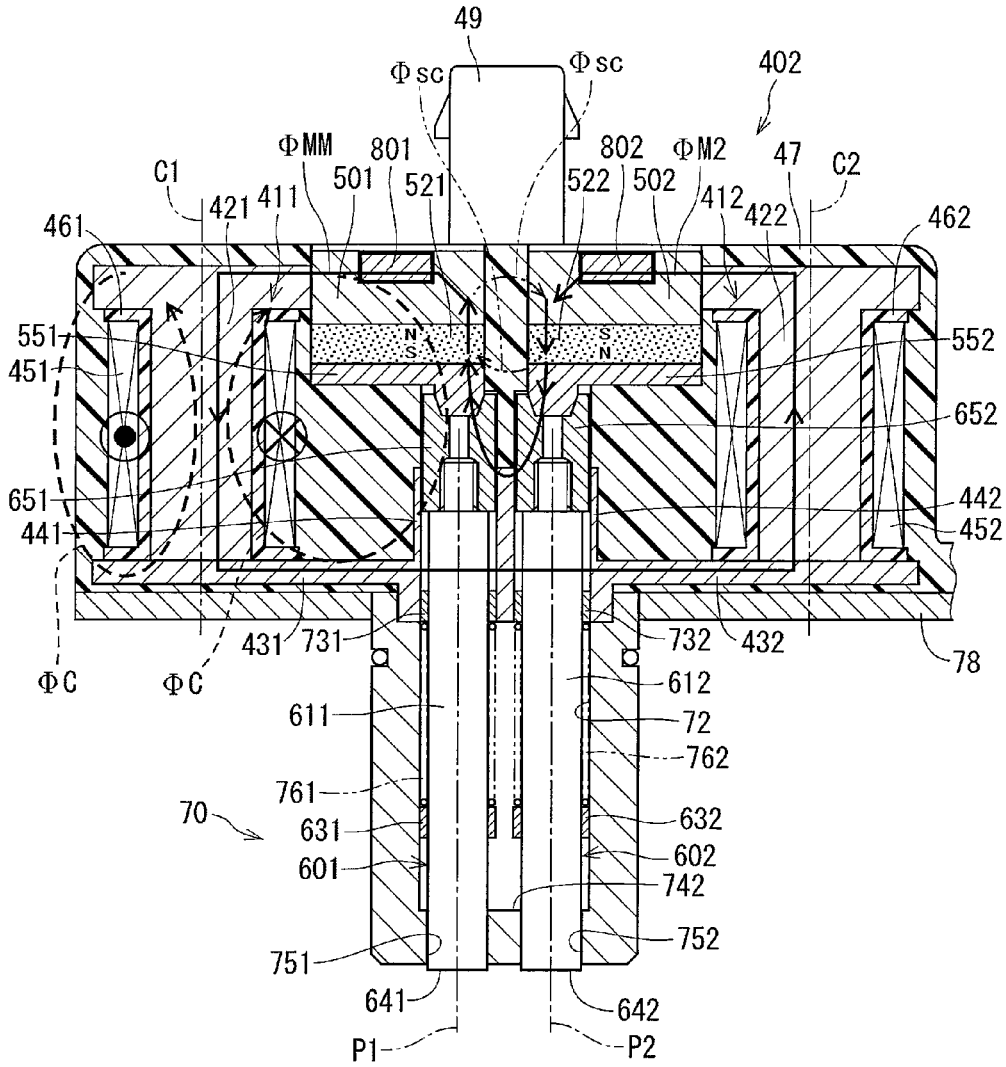
FIG. 9 is a sectional view showing a solenoid actuator according to a second embodiment of the present disclosure.

Subsequently, a solenoid actuator according to the second embodiment of the present disclosure will be described with reference to FIG. 9. As shown in FIG. 9, in a solenoid actuator 402 of the second embodiment, the first permanent magnet 521 and the second permanent magnet 522 are magnetized such that the direction of the magnetic pole of the first permanent magnet 521 and the direction of the magnetic pole of the second permanent magnet 522 are opposite to each other. In the example of FIG. 9, the first permanent magnet 521 has the N pole on the side of the lid 501 and has the S pole on the side of the plunger 651. In addition, the second permanent magnet 522 has the S pole on the side of the lid 502 and has the N pole on the side of the plunger 652.

According to the second embodiment, the two permanent magnets 521 and 522 form the magnetic circuit as follows. Specifically, the N pole of the first permanent magnet 521 generates the magnetic flux ΦMM to pass through the first lid 501, the first rear yoke 411, the first coil core 421, the first front yoke 431, the second front yoke 432, the second coil core 422, the second rear yoke 412, and the second lid 502. Thus, the magnetic flux ΦMM reaches the S pole of the second permanent magnet 522. The N pole of the second permanent magnet 522 generates the magnetic flux ΦMM to pass through the second adapter 552, the second plunger 652, the plunger guide portions 441 and 442, the first plunger 651, and the first adapter 551. Thus, the magnetic flux ΦMM reaches the S pole of the first permanent magnet 521. The permanent magnets 521 and 522, which are adjacent to each other, have different magnetic poles, and the different magnetic poles cause a slight magnetic shortcut ΦSC therebetween. This configuration may be a slight difference from the first embodiment.

Excluding the slight difference from the first embodiment, the present second embodiment may have a commonality with the first embodiment. Specifically, the configuration according to the second embodiment is configured to supply electricity independently to the two coils 451 and 452 corresponding to the two permanent magnets 521 and 522, respectively, to generate the coil magnetic flux ΦC. In this way, the configuration cancels the attraction force of the permanent magnet corresponding to the coil, to which the electricity is supplied, thereby to advance the plunger and the regulation pin by application of the spring force.

In addition, the output of the first magnetometric sensor 801, when the regulation pin 601 completes to advance, changes by ΔV, compared with the de-energized state (refer to FIGS. 8A to 8C). Therefore, similarly to the first embodiment, the configuration according to the second embodiment enables to determine the operation state of the regulation pins 601 and 602 according to the output of the magnetometric sensors 801 and 802 and to recognize which one of the regulation pins 601 and 602 is advanced.

(Third Embodiment)

Subsequently, a solenoid actuator according to the third embodiment of the present disclosure will be described with reference to FIG. 10. As described above, each of the configurations of the first and second embodiments employs a two-coil and two-pin configuration. Specifically, the two-coil and two-pin configuration includes the pair of the coils 451 and 452, the permanent magnets 521 and 522, the springs 761 and 762, the plungers 651 and 652, the regulation pins 601 and 602, and/or the like. To the contrary, the configuration of a solenoid actuator 403 of the third embodiment employs a one-coil and two-pin configuration. Specifically, the one-coil and two-pin configuration includes a singular coil 453, a pair of regulation pins 601 and 602, and/or the like. The one-coil and two-pin configuration may relate to FIG. 7 of Publication of unexamined Japanese patent application No. 2013-258888.

Figure 10:
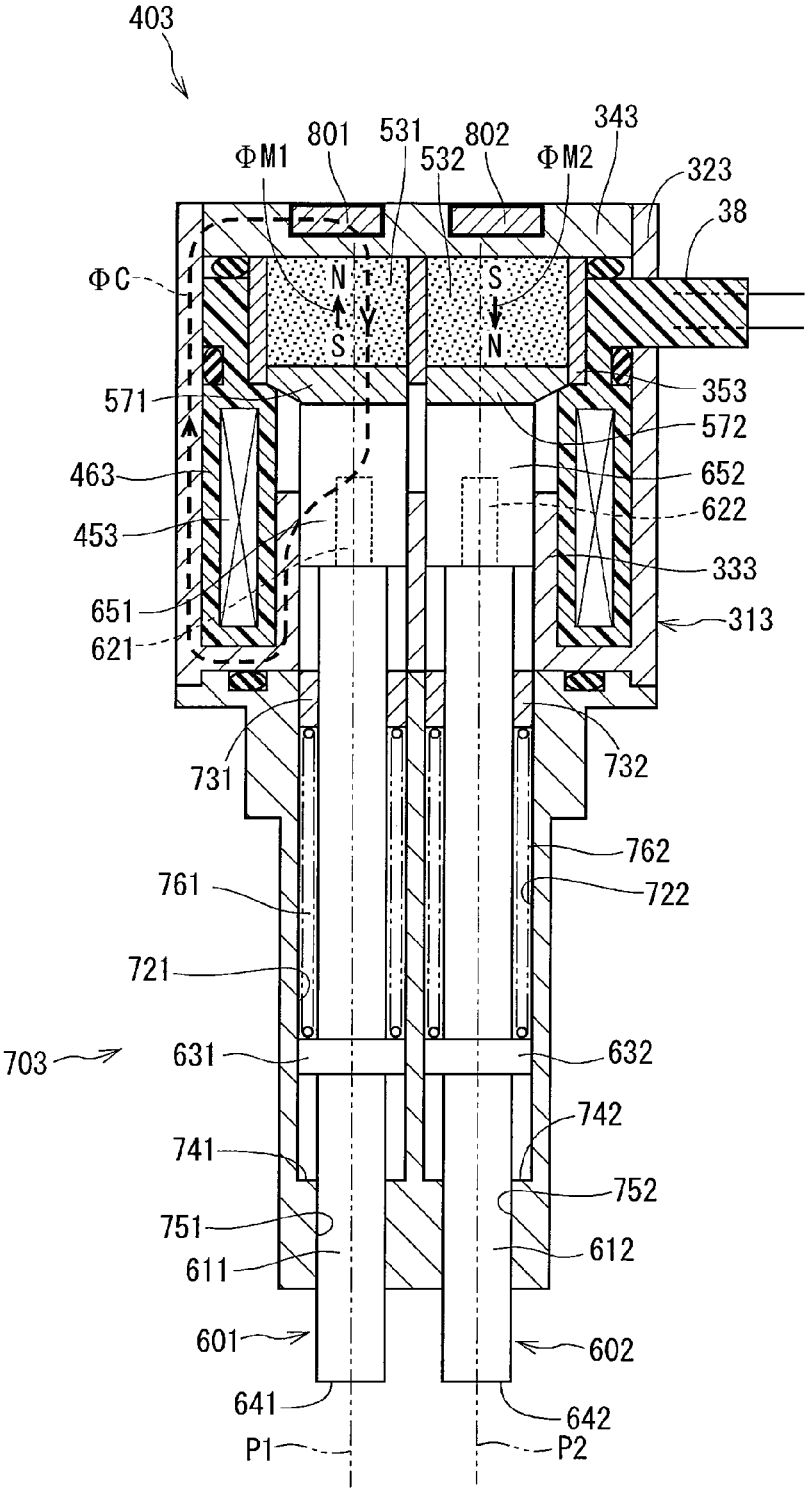
FIG. 10 is a sectional view showing a solenoid actuator according to a third embodiment of the present disclosure.

In FIG. 10, the regulation pins 601 and 602 and the plungers 651 and 652 of the solenoid actuator 403 may be demoted with the reference numerals common to those in the first embodiment. It is noted that, the components in a sleeve 703 may differ from those in the sleeve 70 of the first embodiment in the aspect ratio and in the shape. Nevertheless, the components in the sleeve 703 may have common configurations as those in the sleeve 70 of the first embodiment. Therefore, the components in the sleeve 703 may be denoted with the reference numerals common to those of the components in the sleeve 70 of the first embodiment.

As follows, difference of the third embodiment from the first embodiment will be described briefly. Specifically, the configuration of the stationary portion of the coil 453 such as a yoke 313 shown in the upper portion of the drawing will be described. The yoke 313 is in a double tubular shape and is formed of a soft magnetic material such as a ferrous material. The coil 453, the permanent magnets 531 and 532, the plungers 651 and 652, and/or the like form a magnetic circuit thereamong. The yoke 313 includes an outer tubular portion 323 surrounding the outer periphery of a bobbin 463. The yoke 313 includes an inner tubular portion 333 to guide the movement of the plungers 651 and 652.

A stator 343 is in a plate shape and is formed of a soft magnetic material such as a ferrous material. The stator 343 surrounds the opposite side of the permanent magnets 531 and 532 from the plungers 651 and 652. That is, the stator 343 of the third embodiment may be equivalent to the lids 501 and 502 of the first embodiment in the relation with the permanent magnets 531 and 532. A first magnetometric sensor 801 is equipped on the end surface of the stator 343. The first magnetometric sensor 801 is located directly on the upper side of the first permanent magnet 531. A second magnetometric sensor 802 is equipped on the end surface of the stator 343. The second magnetometric sensor 802 is located directly on the upper side of the second permanent magnet 532.

The magnetometric sensors 801 and 802 are located on the magnetic circuit. The magnetometric sensors 801 and 802 may not need an exclusive space. In addition, the magnetometric sensors 801 and 802 can be easily installed from the upper side of the stator 343. Similarly to the first embodiment, the magnetometric sensors 801 and 802 may be embedded in the recessed portions formed in the stator 343. The magnetometric sensors 801 and 802 may be mounted on the surface of the stator 343. Wiring of the magnetometric sensors 801 and 802 is installed along an unillustrated path and is connected to the external control device via a connector 38.

An external electric power source supplies electricity to the coil 453 via the connector 38, thereby to cause the coil 453 to generate the coil magnetic flux ΦC. The coil magnetic flux ΦC flows through the yoke 313, which is formed of a soft magnetic material, the stator 343, the plungers 651 and 652, and/or the like. The external electric power source may switch the direction (electricity supply direction) of electricity supplied to the coil 453, thereby to cause the coil 453 to generate a coil magnetic flux ΦC2 in the opposite direction. The bobbin 463 is formed of resin and located inside the outer tubular portion 323 of the yoke 313. The bobbin 463 surrounds the periphery of the coil 453 and insulates the coil 453. The connector 38 is formed of resin integrally with the bobbin 463.

The permanent magnets 531 and 532 are accommodated in the holder 353, which is formed of a nonmagnetic material, and is fixed to the holder 353. The third embodiment employs the one-coil configuration. Therefore, the direction of the coil magnetic flux ΦC is along one side. Therefore, in the configuration of the third embodiment, the magnetic fluxes of the permanent magnet 531 and 532 are in the different directions thereby to enable to distinguish the directions of the permanent magnet 531 and 532. In consideration of those issues, the permanent magnets 531 and 532 are magnetized to have the magnetic poles in the opposite directions.

In the example of FIG. 10, the first permanent magnet 531 has the N pole on the side of the stator 343 and has the S pole on the side of the plunger 651. In addition, the second permanent magnet 532 has the S pole on the side of the stator 343 and has the N pole on the side of the plunger 652. The permanent magnets 531 and 532 have the ends on the side of the plungers 651 and 652, respectively, and the ends are equipped with adapters 571 and 572.

The configuration according to the present third embodiment is configured to switch the electricity supply direction for the coil 453. In this way, in the example shown in FIG. 10, the configuration generates the coil magnetic flux ΦC in the direction to cancel the magnetic flux ΦM1 of the first permanent magnet 531. In this way, the configuration reduces the force generated by the first permanent magnet 531 to attract the first plunger 651. Thus, the first regulation pin 601 advances by application of the biasing force of the first spring 761. To the contrary, when the configuration supplies electricity in the opposite direction, the coil magnetic flux ΦC2 is generated in the direction to cancel the magnetic flux ΦM2 of the second permanent magnet 532. Thus, the second regulation pin 602 is advanced.

Similarly to the first embodiment, the magnetic flux density, which is detected with the magnetometric sensors 801 and 802, changes between the state where the regulation pins 601 and 602 are retreated and the state where the regulation pins 601 and 602 are advanced. Therefore, similarly to the first embodiment, the downsized and simplified configuration according to the third embodiment enables to determine the operation state of the regulation pins 601 and 602 according to the output of the magnetometric sensors 801 and 802 and to recognize which one of the regulation pins 601 and 602 is advanced.

(Fourth Embodiment)

Subsequently, a solenoid actuator according to the fourth embodiment of the present disclosure will be described with reference to FIG. 11. A solenoid actuator 404 of the fourth embodiment employs a one-coil and one-pin configuration. Specifically, the one-coil and one-pin configuration includes the first regulation pin 601 and the corresponding components and excludes the second regulation pin 602 and corresponding components from the solenoid actuator 403 of the third embodiment. The one-coil and two-pin configuration may relate to FIG. 19 of Publication of unexamined Japanese patent application No. 2013-258888.

Figure 11:
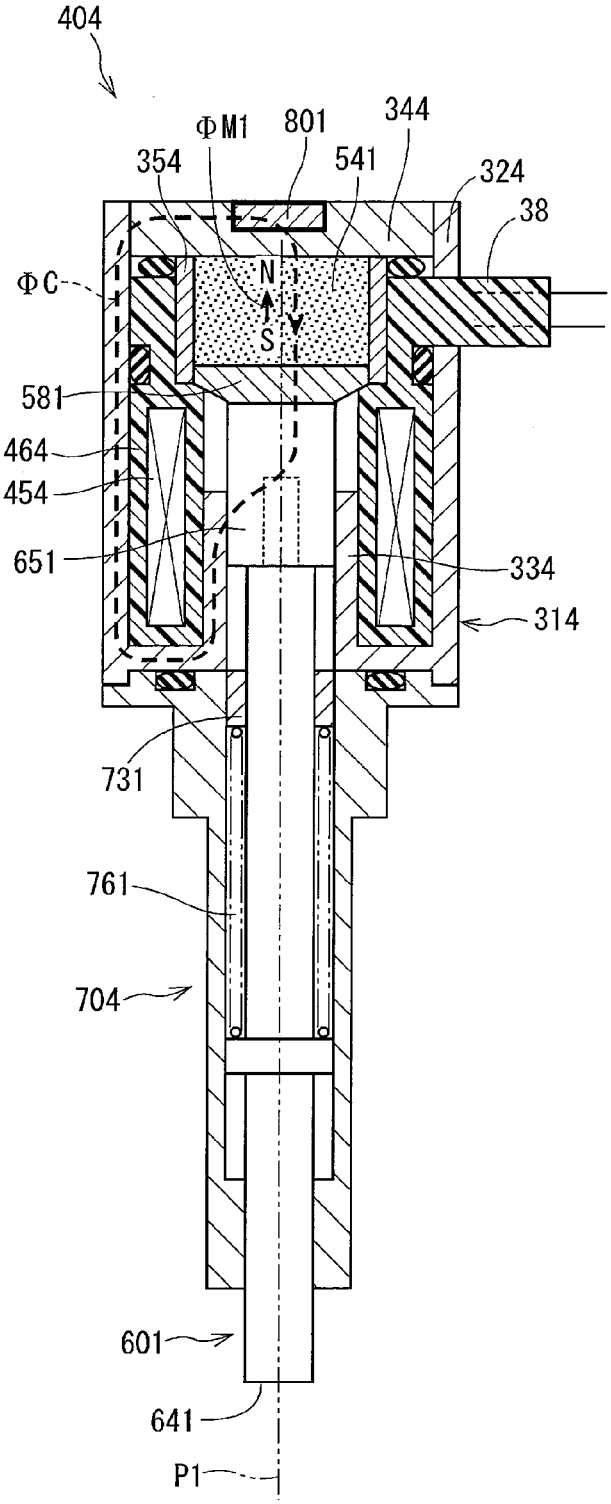
FIG. 11 is a sectional view showing a solenoid actuator according to a fourth embodiment of the present disclosure.

In FIG. 11, the components of the solenoid actuator 404 have functionalities substantially corresponding to those of the solenoid actuator 403 (refer to FIG. 10) of the third embodiment. Specifically, an outer tubular portion 324 and an inner tubular portion 334 of a yoke 314, a stator 344, the holder 354, the coil 454, a bobbin 464, and a sleeve 704, have functionalities of corresponding components of the solenoid actuator 403 and are denoted with reference numerals in which the last digit denoted with 3 of the corresponding component is replaced with 4. A permanent magnet 541 has the functionality corresponding to that of the two permanent magnets 531 and 532 of the third embodiment, which are combined into one component in the concentric shape centering on the pin axis P1. A adapter 581 has the functionality corresponding to that of the two adapters 571 and 572 of the third embodiment, which are combined into one component in the concentric shape centering on the pin axis P1.

A singular magnetometric sensor 801, which is similar to those of the above-described embodiments, is equipped to the end surface of the stator 344 on the opposite side of the permanent magnet 541 from the plunger 651. Similarly to the above-described embodiments, the magnetometric sensor 801 is located on the magnetic circuit. The magnetometric sensor 801 may not need an exclusive space. In addition, the magnetometric sensor 801 can be easily installed from the upper side of the stator 344.

In the example of FIG. 11, the stator 344 has the N pole on the side of the plunger 651 and has the S pole on the side of the permanent magnet 541. When electricity is supplied to the coil 454, the coil magnetic flux ΦC is generated in the direction to cancel the magnetic flux ΦM1 of the permanent magnet 541, thereby to reduce the force of the permanent magnet 541, which attracts the plunger 651. Thus, the regulation pin 601 is advanced by application of the biasing force of the spring 761. In the present state, the magnetic flux density, which is detected with the magnetometric sensor 801, changes between the state where the regulation pin 601 is retreated and the state where the regulation pin 601 is advanced. Therefore, the downsized and simplified configuration enables to determine the operation state of the regulation pin 601 according to the output of the magnetometric sensor 801.

(Other Embodiment)

Figure 12:
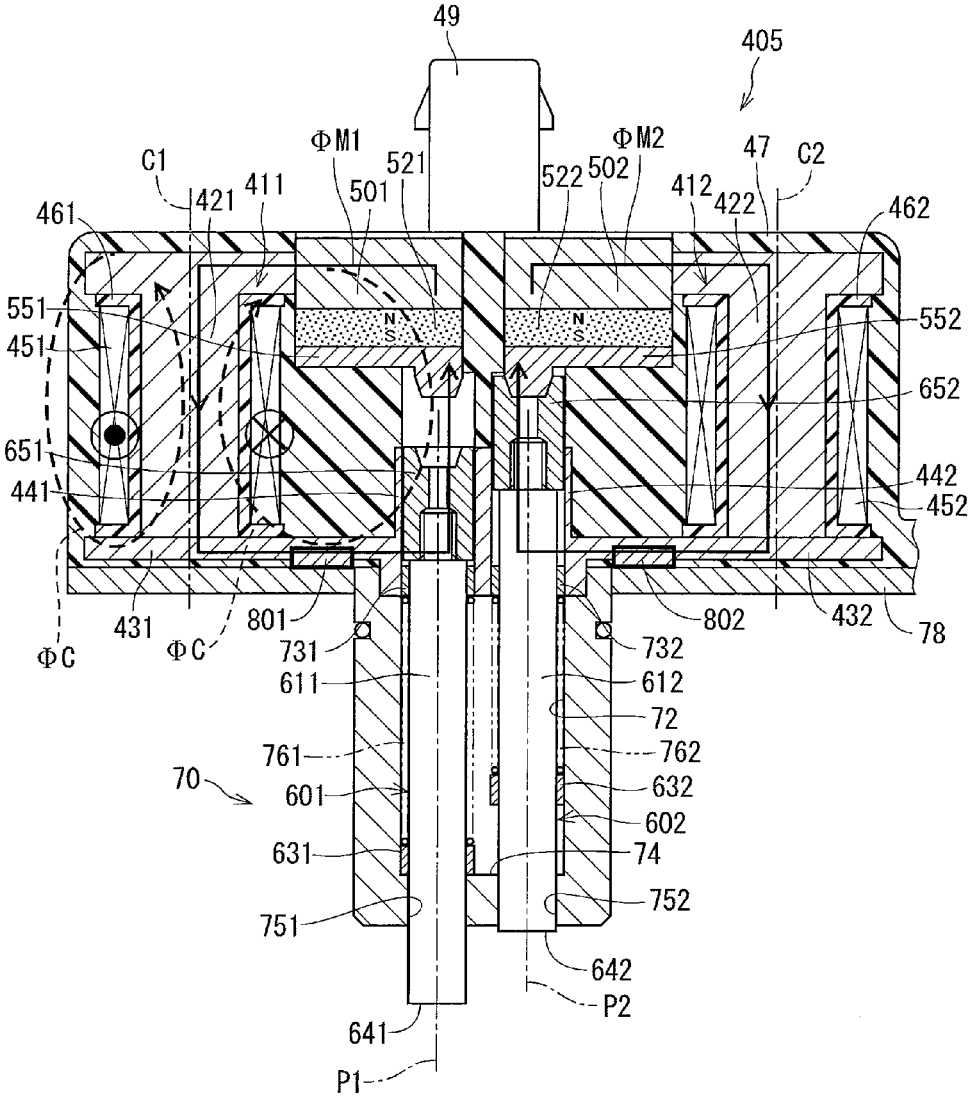
FIG. 12 is a sectional view showing a solenoid actuator according to an other embodiment of the present disclosure.

(a) According to the above-described embodiments, the magnetometric sensors 801 and 802 are located on the magnetic circuits. In addition, the magnetometric sensors 801 and 802 are equipped to the end surfaces of the lids 501 and 502 or the end surfaces of the stators 353 and 354 on the opposite side of the permanent magnets 521 and 522 from the plungers 651 and 652, respectively. To the contrary, as exemplified in a solenoid actuator 405 shown in FIG. 12, the magnetometric sensors 801 and 802 may be located on the magnetic circuits and may be located on the side of the plungers 651 and 652 relative to the permanent magnets 521 and 522, respectively. For example, the magnetometric sensors 801 and 802 may be equipped to the front yokes 431 and 432, respectively. Even in the present configuration, the magnetic flux density, which the magnetometric sensors 801 and 802 detect, changes between the state where the regulation pins 601 and 602 are retreated and the state where the regulation pins 601 and 602 are advanced. Therefore, the present configuration enables to determine the operation state of the regulation pins 601 and 602.

(b) In the above embodiments, the configuration, in general, detects the regulation pins 601 and 602 being at the stable position according to the output of the magnetometric sensors 801 and 802. The stable position may be the most retreated position or may be the most advanced position. It is noted that, it may be hard to enable an actual product to satisfy a required accuracy when detecting dynamically a stroke of the regulation pins 601 and 602 under operation. The dynamic detection may be subject to influence of variation in the coil magnetomotive force, variation in the magnetism of the permanent magnet, and variation in spring force and/or the like. The dynamic detection may be subject to influence of response of the sensor signal. It is noted that, it is theoretically possible to estimate the stroke according to change in the magnetic flux density detected with the magnetometric sensor. For example, the detection may be enabled by managing the dimensional tolerance of components strictly and/or by regulating an environmental temperature and/or an operation condition. Therefore, the technical scope of the present disclosure encompasses an embodiment of a solenoid actuator to detect the stroke.

(c) In the above-described embodiments, the magnetism detection unit is located on the magnetic circuit. The configuration of the components of the solenoid actuator, such as the elements of the magnetic circuit and the permanent magnet, those shape, those physical relationship, and/or the like are not limited to those in the embodiments. The fitting portion and the receiver portion may not be equipped in the adapter and the plunger. The adapter and the plunger may transmit the magnetic flux via flat surfaces. The adapter may be omitted.

(d) In the above embodiments, the solenoid actuators equipped with one regulation pin or two regulation pins are exemplified. It is noted that, the present disclosure may be applied to a solenoid actuator equipped with three or more regulation pins.

According to the present disclosure, the solenoid actuator may be employed in a valve lift control device for an internal combustion engine. The solenoid actuator may include the plunger and the solenoid actuator. The plunger is applied with an attraction force of the permanent magnet. When electricity is supplied to the coil, the attraction force of the permanent magnet is decreased. The solenoid actuator moves the regulation pin, which is connected with the plunger, in the advanced direction by application of the biasing force of the spring. The permanent magnet is to attract the plunger in the retreated direction. The permanent magnet is fixed to the stationary portion. The stationary portion is stationary with respect to the plunger. The magnetism detection unit is equipped on the magnetic circuit, which conducts the magnetic flux. The magnetic flux is generated by the permanent magnet and the coil. The magnetism detection unit detects the magnetic flux density.

The magnetism detection unit detects the change in the magnetic flux density between the magnetic flux density in the state where the plunger is retreated relative to the permanent magnet and the magnetic flux density in the state where the plunger is advanced relative to the permanent magnet. The solenoid actuator has the configuration including the permanent magnet affixed to the stationary portion. The solenoid actuator is configured to determine the operation state of the regulation pin suitably.

The magnetism detection unit according to the present disclosure may be equipped to the end surface on the opposite side of the permanent magnet from the plunger. The present arrangement may not need an exclusive space for the magnetism detection unit and may facilitate installation of the magnetism detection unit. Therefore, the present configuration may enable to downsize and to simplify the solenoid actuator compared with the conventional configuration of Patent Document 1.

The configuration according to the present disclosure may be applicable to the solenoid actuator including the two regulation pins, which are equipped in parallel with each other. The solenoid actuator may include the two plungers, the two permanent magnets, the two springs, and the two magnetism detection units corresponding to the two regulation pins.

The solenoid actuator causes the coil to generate the magnetic flux in the opposite direction of the permanent magnet, which corresponds to one of the regulation pins, to reduce the magneto attraction force when electricity is supplied to the coil.

Thus, the solenoid actuator moves the regulation pin as the operation-side regulation pin. The solenoid actuator enables to recognize which one of the regulation pins is operated according to the output of the magnetism detection unit.

The above processings such as calculations and determinations may be performed by any one or any combinations of software, an electric circuit, a mechanical device, and the like. The software may be stored in a storage medium, and may be transmitted via a transmission device such as a network device. The electric circuit may be an integrated circuit, and may be a discrete circuit such as a hardware logic configured with electric or electronic elements or the like. The elements producing the above processings may be discrete elements and may be partially or entirely integrated.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A solenoid actuator for a valve lift control device, the valve lift control device being configured to control a lift of an intake valve or a lift of an exhaust valve of an internal combustion engine, the valve lift control device having a slider, which is rotatable with a camshaft and is movable in an axial direction relative to the camshaft, the solenoid actuator configured to advance a regulation pin when fitting a tip end of the regulation pin to a fitting groove of the slider, the solenoid actuator further configured to cause the regulation pin pushed back by application of a torque of the camshaft when retreating the tip end of the regulation pin from the fitting groove, the solenoid actuator comprising:

the regulation pin configured to advance to the fitting groove;

a plunger formed of a soft magnetic material, the plunger being movable along a direction and having one end connected with the regulation pin;

a permanent magnet affixed to a stationary portion, which is stationary relative to the plunger, and configured to attract the plunger in a retreated direction;

a coil configured to generate a magnetic flux in an opposite direction of the permanent magnet to reduce a magneto attraction force, which attracts the plunger;

a spring configured to bias the regulation pin in an advanced direction, the spring configured to apply a biasing force to the regulation pin to move the regulation pin in the advanced direction when electricity is supplied to the coil to reduce the magneto attraction force of the permanent magnet; and a magnetism detection unit disposed on a magnetic circuit separate from the coil and configured to detect a magnetic flux density, the magnetic circuit configured to conduct a magnetic flux generated by the permanent magnet and the coil;

a molded portion defining a magnet accommodation hole in which the permanent magnet is housed; and a cover member covering the permanent magnet housed in the magnet accommodation hole , wherein the magnetism detection unit is a hall element or a magnetoresistive element, the cover member includes an inner surface and an outer surface that are opposite to each other in the direction of the plunger, the inner surface faces the permanent magnet, the outer surface is exposed to an outside of the magnet accommodation hole, and the magnetism detection unit is disposed in the outer surface of the cover member.

2. The solenoid actuator according to claim 1, wherein the regulation pin includes two regulation pins, which are located in parallel to each other, the plunger includes two plungers, the permanent magnet includes two permanent magnets, the spring includes two springs, and the magnetism detection unit includes two magnetism detection units corresponding to the two regulation pins, and when electricity is supplied to the coil, the coil is configured to generate a magnetic flux in an opposite direction of one of the permanent magnets, which corresponds to one of regulation pins, to reduce a magneto attraction force and to advance the one of regulation pins as an operation-side regulation pin.

3. The solenoid actuator according to claim 1, wherein the magnetism detection unit is disposed in the cover member is a lid that covers the permanent magnet and serves as the stationary portion.

4. The solenoid actuator according to claim 3, wherein the magnetism detection unit is embedded in a recessed portion that is recessed from the outer surface of formed in the lid.

5. The solenoid actuator according to claim 1, wherein the magnetism detection unit is disposed at a position closer to the plunger than the coil is to the plunger in a radial direction of the plunger.

6. A solenoid actuator comprising:

a plunger formed of a soft magnetic material, the plunger being movable along a direction;

a regulation pin connected to one end of the plunger, the regulation pin having a tip end configured to advance and to retreat;

a permanent magnet affixed to a stationary portion, which is stationary relative to the plunger, the permanent magnet configured to generate a magnetic flux and a magneto attraction force to attract the plunger in a retreated direction;

a coil configured to generate a magnetic flux in an opposite direction of the magnetic flux of the permanent magnet to cancel the magnetic flux of the permanent magnet and to reduce the magneto attraction force;

a spring configured to apply a biasing force to the regulation pin to move the regulation pin in an advanced direction when electricity is supplied to the coil to reduce the magneto attraction force of the permanent magnet; and a magnetism detection unit disposed on a magnetic circuit separate from the coil and configured to detect a magnetic flux density, the magnetic circuit configured to conduct a magnetic flux generated by the permanent magnet and the coil;

a molded portion defining a magnet accommodation hole in which the permanent magnet is housed; and a cover member covering the permanent magnet housed in the magnet accommodation hole, wherein the magnetism detection unit is a hall element or a magnetoresistive element, the cover member includes an inner surface and an outer surface that are opposite to each other in the direction of the plunger, the inner surface faces the permanent magnet, the outer surface is exposed to an outside of the magnet accommodation hole, and the magnetism detection unit is disposed in the outer surface of the cover member.

* * * * *